United States Patent [19]

Neuhierl

[11] 4,181,830

[45] Jan. 1, 1980

[54] FLIGHT CONTROL SYSTEM FOR FREE FLIGHT MODEL AEROPLANES

[76] Inventor: Hermann Neuhierl, Waldstrasse 36, D-8510 Furth, Bayern, Fed. Rep. of Germany

[21] Appl. No.: 791,467

[22] Filed: Apr. 27, 1977

[30] Foreign Application Priority Data

Apr. 29, 1976 [DE] Fed. Rep. of Germany ..... 2618921

[51] Int. Cl.[2] ..... H01H 7/00; H01H 43/00; A63H 29/02

[52] U.S. Cl. ..... 200/35 H

[58] Field of Search ..... 200/35 R, 35 H, 33 R; 46/78, 249

[56] References Cited

U.S. PATENT DOCUMENTS

| | | | |
|---|---|---|---|
| 2,274,635 | 3/1942 | Rhodes | 200/35 H X |
| 3,074,204 | 1/1963 | Tatone | 46/78 |
| 3,745,699 | 7/1973 | Mabuchi | 46/249 |
| 3,757,462 | 9/1973 | Mabuchi | 46/249 |
| 3,819,885 | 6/1974 | Moroto et al. | 200/35 R |
| 3,864,539 | 2/1975 | Hauser | 200/35 R X |

FOREIGN PATENT DOCUMENTS 659275 10/1951 United Kingdom .

*Primary Examiner*—James R. Scott
*Attorney, Agent, or Firm*—Scully, Scott, Murphy & Presser

[57] ABSTRACT

A control system for controlling the flight of a free flight model aeroplane having an electrically powered drive unit and a tail unit comprising a thermal air current brake comprises a time switch for releasing the thermal air current brake and for interrupting the supply of power to the drive unit. The time switch comprises a spring mechanism, means for winding up the spring mechanism, the spring mechanism including a shaft, a control disc provided on the shaft, a peripheral recess and a cam surface being provided on the control disc or on a disc which is fast therewith in use. The peripheral recess is associated with and engageable with one arm of a two arm release lever such that when engaged by the one arm and rotated through a prescribed angle, the one arm will be released to undergo swivelling motion. The other arm of the release lever is connectable through tensioning means to the tail assembly of the aeroplane such that swivelling of the first arm causes actuation of the thermal air current brake. The cam surface controls switch means for supply of power to the drive unit.

6 Claims, 3 Drawing Figures

FLIGHT CONTROL SYSTEM FOR FREE FLIGHT MODEL AEROPLANES

BACKGROUND OF THE INVENTION

This invention relates to a control system for controlling the flight of a free flight model aeroplane having an electrically powered drive unit and a tail unit comprising a thermal air current brake.

In non-motor driven free flight model aircraft or model gliders, it is necessary to provide a thermal air current brake. Such a thermal air current brake generally consists of lifting brake flaps in the region of the tail unit of the aircraft for terminating the flying time thereof. If no such brake is provided and extremely good flying conditions with considerable thermal air currents prevail, it may happen that a free flight model can travel so far as to become irretrievable.

Switches for thermal air current brakes have been devised for effecting a termination of flying. Time switches have been used in model aircraft provided with international combustion engines, the switches also serving to control operation of thermal air current brakes. For example, U.S. Pat. No. 3,074,204 describes a time switch which comprises a two armed release lever providing two switching mechanisms which are operated by spring mechanisms to be wound by hand individually. One switching mechanism is connected by tensioning means to the tail unit of the aeroplane and the other to the fuel supply for the internal combustion engine for driving the aeroplane. The two switching mechanisms can be set independently of one another and are connected by a plurality of gear wheels to a device common to the two mechanisms which controls the time when braking of the plane or supply of fuel to the engine is to be effected. The switching mechanism is very complicated and very costly to manufacture due to the large number of parts thereof, in particular the large number of gear wheels. Moreoever, the structural parts add considerably to the weight of the aeroplane. This is a considerable disadvantage with model areoplanes since every gram matters with such devices, if the flying properties and range of flight are not to be significantly effected.

Another form of time switch which is described in British Patent Specification No. 659,275 controls the interruption of the supply of power to the electrical drive motor of a model aeroplane. This switch does not control the tail unit.

Moreover, German Utility Model No. 7,147,062 discloses the provision of a control disc for a time switch in a toy aeroplane having an electric motor. This disc holds a spring in a tensioned position, a notch being provided on the rim of the control disc through which the spring can be released, thereby to open a contact and interrupt the supply of current to the electric motor of the aeroplane. Moreover, the control disc is connected to a control and steering gear which serves to control the steering wheel or wheels of the aeroplane.

SUMMARY OF THE INVENTION

It is an object of this invention to provide a simplified control system for controlling operation of both the drive motor and a thermal air current brake of an electrically driven free flight model aeroplane provided with a thermal air current brake.

It is a further object of this invention to provide a time switch for controlling operation of the drive motor and a thermal air current brake of a free flight model aeroplane as aforesaid, in which independent setting of a switch for the motor and a switch for a thermal air current brake is possible.

According to the present invention, there is provided a control system for controlling the flight of a free flight model aeroplane having an electrically powered drive unit and a tail unit comprising a thermal air current brake, comprising a time switch for releasing the thermal air current brake and for interrupting the supply of power to said drive unit, the time switch comprising a spring mechanism, means for winding up the spring mechanism, the spring mechanism including a shaft, a control disc provided on said shaft, a peripheral recess and a cam surface, each of the peripheral recess and the cam surface being provided on the control disc or on a disc which is fast therewith in use, the peripheral recess being associated with and engageable with one arm of a two arm release lever such that when engaged by said one arm and rotated through a prescribed angle, said one arm will be released to undergo swivelling motion, the other arm of the release lever being connectable through tensioning means to the tail assembly of the aeroplane such that said swivelling motion causes actuation of the thermal air current brake, and the cam surface controlling switch means for supply of power to the drive unit.

This invention also provides a free flight model aeroplane which comprises a control system as aforesaid mounted in or on the fuselage and fitted with the two arm release lever so positioned that said one arm is engageable with the peripheral recess and the other arm being connected through tensioning means to the tail assembly of the aeroplane.

With a control system according to this invention, a single time switch is provided for achieving release of a thermal air current brake and disconnecting the drive motor, the time switch being of particularly simple construction. It is possible for both the peripheral recess and the cam surface to be provided on the control disc. In such a case, the control disc can be so designed that the release of the thermal air current brake and the switching off of the drive unit occur simultaneously or at predetermined time intervals determined by the angular disposition with respect to each other of the peripheral recess and the cam surface.

Alternatively, separate discs may be mounted on the shaft of the spring mechanism, one disc carrying the peripheral recess and the other carrying the cam surface. Whilst these discs will need to be fast with one another when the time switch is set, they can be rotatable independently of each other when setting the time switch so that release of the thermal air current brake and switching off of the drive unit may be effected at different times, the time interval between these operations being varied in accordance with the angular separation given to the peripheral recess and the cam surface. It is preferred then that the outer of the two discs carry the peripheral recess and the inner be a cam disc.

When separate recessed and cam discs are provided, it is particularly expedient if the recessed disc lying over the cam disc as in preferred practice is arranged fast against rotation on the shaft and the coaxial cam disc is capable of such rotation, the two discs being capable of being pressed together by means of a lock nut adapted to fit a threaded lug on the shaft of the spring mechanism. In this way, disconnection of the drive motor by activation of a microswitch in an electrical circuit can be effected simultaneously with, in advance of, or after release of the thermal air current brake depending upon the preset angular disposition of the cam disc with respect to the recessed disc.

Any suitable means may be provided for winding up the spring mechanism. Such winding up may readily be provided by rotating a control disc when provided fast on the shaft, possibly with the assistance of handles mounted on the face of the control disc. Whilst the cam of the cam disc may act directly on a microswitch in the electric circuit of the drive motor, a particularly simple construction is achieved if the cam displaces a lever which in turn activates the microswitch.

BRIEF DESCRIPTION OF THE DRAWINGS

For a better understanding of this invention and to show how the same can be carried into effect, reference will now be made, by way of example only, to the accompanying drawings, wherein.

DETAILED DESCRIPTION OF THE INVENTION

Figure 1:
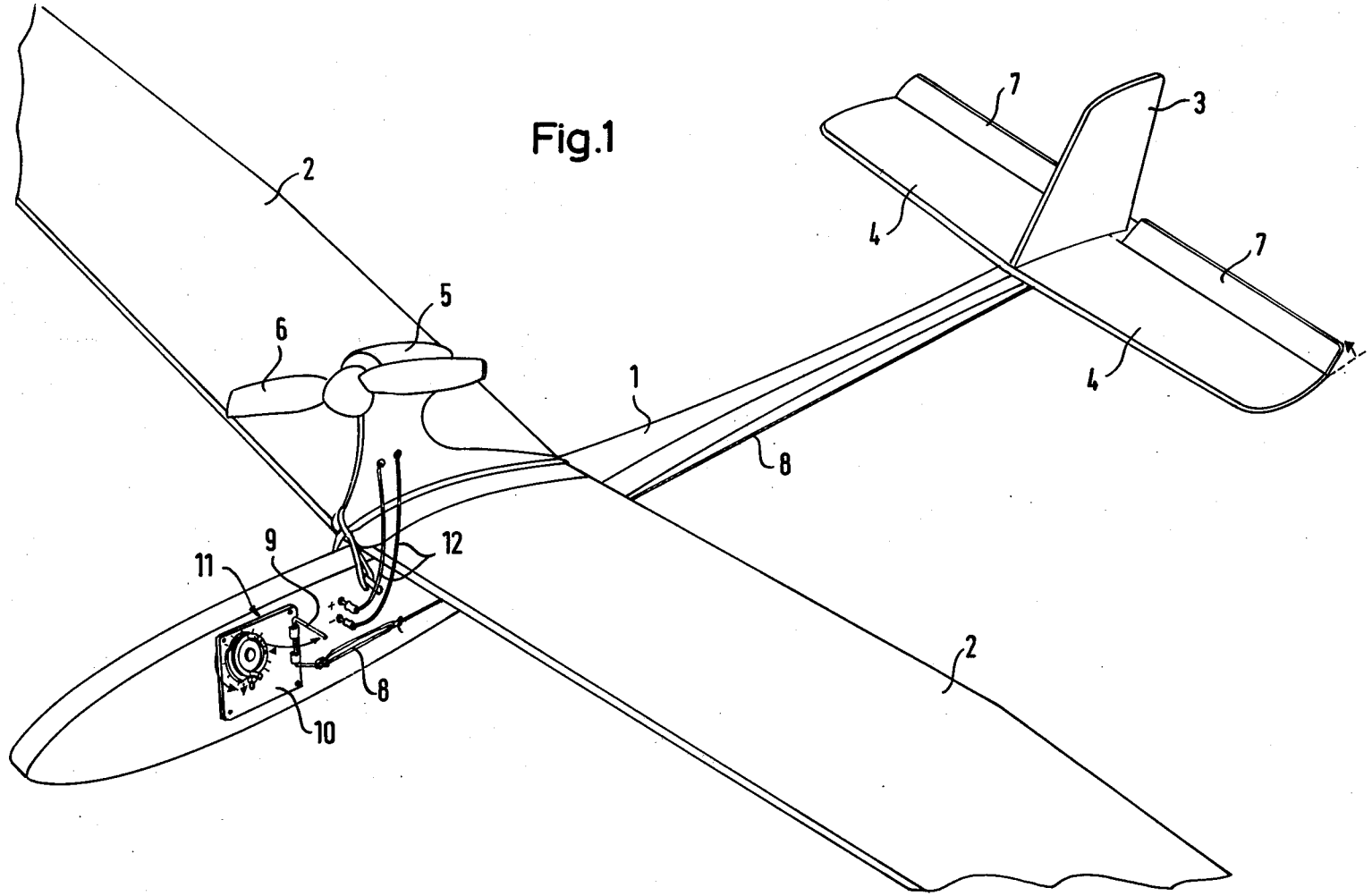
FIG. 1 shows schematically and as a part fragmentary representation, a perspective view of a model plane equipped with a time switch according to this invention.

Referring to FIG. 1, there is shown a model plane having a fuselage 1 with wings 2, a rudder assembly 3 and a tail assembly 4. An electric drive motor with propeller 6 is disposed in a structure 5 disposed above the fuselage and the wings 2. Thermal air current brake flaps 7 which are shown in the raised braking position are provided on the rear edges of the horizontal tail surfaces 4. The brake flaps 7 are held in this position by the action of a spring and can be held in a retracted position in the plane of the tail assembly surfaces 4 by the action of a cable pulley 8 extending forwards in the fusilage and held under spring tension. The front end of the cable pulley 8 is attached to a swivellable release lever 9 which is mounted on a panel 10 of a time switch to form therewith a time switch assembly which bears the reference numeral 11. Supply lines 12 extend from a battery (not visible) to the electric motor. The construction of the time switch will now be explained in more detail with reference to FIGS. 2 and 3.

Figure 3:
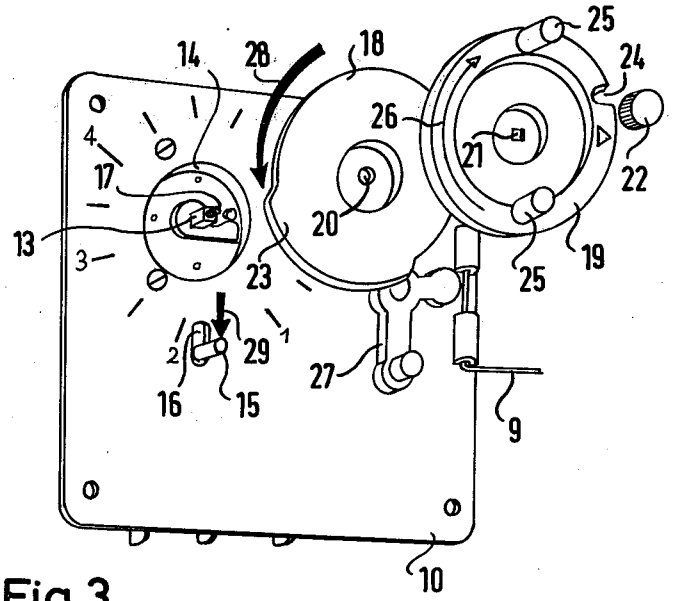
FIG. 3 shows an exploded view of the time switch shown in FIG. 2.
Figure 2:
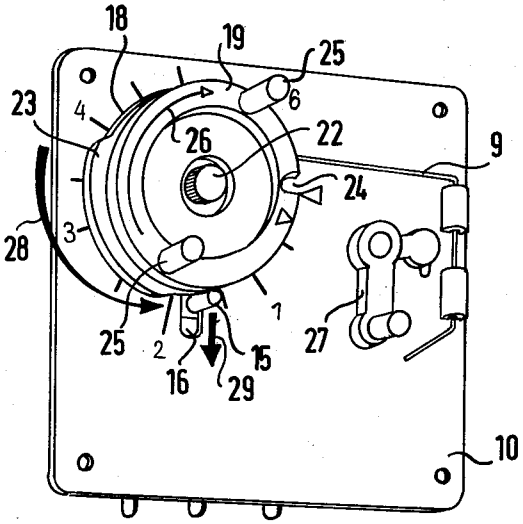
FIG. 2 shows in perspective front elevation and on an enlarged scale, the time switch of the plane shown in FIG. 1.

FIGS. 2 and 3 show the front face only of the time switch 11, that is the parts arranged on the panel 10. Behind the panel 10 there is disposed a normal clock spring mechanism having a shaft 13 which projects through an opening 14 in the panel 10 onto the front face of the panel 10 (FIG. 3). In addition, a microswitch which lies in the electric circuit between the aforesaid batteries in the fuselage and the drive motor in the structure 5 is located on the rear side of the panel. A switch lever acting on a switch contact of the microswitch projects with an extension 15 through an opening 16 in the panel 10 onto the front face of the panel. The shaft 13 of the clock spring mechanism is foursided and has a threaded lug 17 on its front end. A cam disc 18 and a control disc 19 are disposed on the shaft 13. The cam disc 18 has a central circular opening 20 which enables the square shaft 13 to pass therethrough and permits rotation of the cam disc 18 with respect to the square shaft 13. The control disc 19 has an opening 21 matched to the square cross-section of a shaft 13 and is disposed fast against rotation on the square shaft 13. The two discs 18 and 19 are held clamped by a clamping screw 22 which fits onto the threaded lug 17 in such manner that rotation of the cam disc 18 relative to the shaft 13 is possible when the clamping screw is not fully tightened up, although such rotation is prevented when the clamping screw is tightened so that the cam disc 18 is then fixed relative to both the control disc 19 and the shaft 13.

The cam disc 18 has an extension flange 23 around part of the periphery thereof and in the path of which, as the cam disc rotates, in use, lies the extension 15 of the switch lever for the microswitch. A recess 24 is provided on the periphery of the control disc 19 so that the release lever 9 held behind the control disc 19 can swivel forward into the position shown in FIG. 1 when the recess 24 moves into a position level with the release lever 9. Forwardly projecting handles 25 for manual rotation of the control disc 19 in the direction of an arrow 26 are provided on the control disc 19 for winding up of the spring mechanism when presetting a time on the time switch. A further lever 27 visible on the front face of the panel 10 is for connecting and disconnecting the spring mechanism on the rear side of the panel 10.

If the spring mechanism is initially wound by use of the handles 25 to rotate the control disc 19 in the direction of the arrow 26 and runs down after release by the lever 27, then the cam disc 18 and the control disc 19 rotate in the direction of arrow 28. At a time depending on the preset rotational position of the cam disc 18 on the shaft 13, the flange 23 of the cam disc eventually comes into abutment with the extension 15 of the switch lever for the microswitch and presses the switch lever downwards in the direction of arrow 29, whereupon the microswitch interrupts the electric circuit of which the drive motor forms a part. If, on rotation of the control disc 19 in the direction of the arrow 28, the recess 24 moves into a position level with the release lever 9, the release lever 9 is rotated forwards under the initial tension of the cable pulley 8 through the recess 24 into the position shown in FIG. 1 so that the thermal air current brake flaps 7 are extended. synchronization of the release of the thermal air current brake flap 7 and the disconnection of the drive motor can be effected by suitable rotating of the cam disc 18 relative to the control disc 19 when setting the time switch; that is, by positioning the flange 23 on the cam disc 18 at a suitable angular position relative to the recess 24 on the control disc 19. This adjustment may be made simply by loosening the clamping screw 22, rotating the cam disc 18 through a suitable angle and tightening the screw 22.

The clamping screw 22 is in a tightened state during normal operation of the aeroplane whereby the cam and control discs 18 and 19 rotate in unison, with the position of cam disc 18 controlling the state of the microswitch and the position of control disc 19 controlling the release of lever 9 through recess 24 to release the air brakes.

If operation of the thermal air current brake flap 7 and the interruption of the supply of power to the drive motor are always to be effected simultaneously or at a fixed time interval from one another, the time switch can be simplified by providing the control disc 19 with a cam surface itself and dispensing with cam disc 18.

I claim:

1. A control system for controlling the flight of a free flight model aeroplane having an electrically powdered drive unit and a mechanically operated tail unit including a thermal air current brake, and a time switch means for releasing the thermal air current brake and for interrupting the supply of power to said drive unit, the improvement in the time switch means comprising time delay actuating means having a spring mechanism, means for winding up the spring mechanism, the spring mechanism including a shaft rotatably mounted in the time switch means, a control disc means provided on said shaft for rotation therewith, a peripheral recess provided on said control disc means and a cam surface provided on said control disc means, the peripheral recess being associated with an engageable with one arm of a two arm release lever pivotally mounted in the control system such that when engaged by said one arm and rotated through a prescribed angle, said one arm will be released to undergo pivoting motion, the other arm of the release lever being connectable through tensioning means to the tail unit of the aeroplane such that said pivoting motion causes actuation of the thermal air current brake, and the control disc means having cam surface controlling switch means for supply of powder to the drive unit.

2. A control system according to claim 1, wherein said control disc means includes a single control disc in which said peripheral recess and said cam surface are provided.

3. A control system according to claim 1, wherein said control disc means includes two control discs positioned one behind the other on said shaft such that one disc is a forward disc and one disc is a rearward disc, the rearward of the control discs being formed with said cam surface and the forward of said control disc being formed with said recess.

4. A control system as claimed in claim 3, said shaft being formed in the region of the more forward of the two control discs with a portion having edges abutting one face to the forward control disc and the central opening of said foward disc being the same shape as a second portion of the shaft, and the shaft being formed with a threaded lug on which a clamping nut is screwed.

5. A control system as claimed in claim 4, wherein the rearward of said discs is arranged so as to be rotatable on the shaft relative to the forward disc to allow the relative control actions of the forward and rearward discs to be changed.

6. A control system according to claim 1, wherein said time switch means further includes another lever for actuating a microswitch in an electric circuit including the electric drive motor, the lever being displaced by said cam surface on rotation of said control disc means when the cam surface engages the lever.

* * * * *